US005634820A

United States Patent [19]

Vakil

[11] Patent Number: 5,634,820

[45] Date of Patent: Jun. 3, 1997

[54] FLUORESCENT LIGHT ADAPTOR MODULE

[75] Inventor: Usman Vakil, Walnut, Calif.

[73] Assignee: Lights of America, Inc., Walnut, Calif.

[21] Appl. No.: 209,218

[22] Filed: Mar. 11, 1994

[51] Int. Cl.[6] ..... H01J 7/44

[52] U.S. Cl. ..... 439/646; 439/236; 362/226; 313/318.01; 315/56; 315/58

[58] Field of Search ..... 362/226; 313/318.01, 313/318.09; 315/56, 58; 439/646, 645, 236

[56] References Cited

U.S. PATENT DOCUMENTS

| | | | |
|---|---|---|---|
| 4,623,823 | 11/1986 | Engel | 315/58 |
| 4,683,402 | 7/1987 | Aubrey | 315/56 |
| 4,723,200 | 2/1988 | Troen | 439/236 |
| 4,746,840 | 5/1988 | Lim | 315/56 |
| 4,931,696 | 6/1990 | Brower | 315/58 |
| 4,936,789 | 6/1990 | Ugalde | 439/646 |
| 5,189,339 | 2/1993 | Peshak | 315/56 |
| 5,286,216 | 2/1994 | Volz | 439/646 |
| 5,537,301 | 7/1996 | Martich | 362/226 |
| 5,545,950 | 8/1996 | Cho | 362/226 |

*Primary Examiner*—Gary F. Paumen
*Attorney, Agent, or Firm*—Graham & James LLP

[57] ABSTRACT

A module including a starter assembly and a fluorescent tube assembly is provided to allow the use of fluorescent lighting in a standard incandescent light bulb socket. The starter assembly is coupled to the tube assembly using a coupling system that includes a support plug which protrudes from the starter assembly and is inserted into a receptacle provided in the tube assembly.

15 Claims, 3 Drawing Sheets

FLUORESCENT LIGHT ADAPTOR MODULE

FIELD OF THE INVENTION

The present invention is directed to a fluorescent light adaptor module for use in a standard incandescent bulb socket. More particularly, the present invention is directed to a fluorescent light adaptor module having an improved structure for connecting a fluorescent tube assembly to a starter/ballast circuit.

BACKGROUND OF THE INVENTION

Numerous homeowners and businesses are looking for ways to reduce their electrical consumption for a variety of reasons. Some people are reducing the amount of electrical consumption to save money, while others are doing so to conserve energy, thereby reducing pollution associated with power production. A known way of achieving a reduction in electrical consumption is to switch from incandescent to fluorescent lighting.

Fluorescent lights are capable of producing the same amount of light as incandescent bulbs while utilizing a significantly reduced amount of electrical power to produce the same amount of light. Accordingly, homes or businesses which convert from incandescent to fluorescent lighting can see significant energy cost savings through such a conversion. Reduced power consumption decreases the demand for power from electric utilities, and thus contributes to environmental conservation by reducing the consumption of fossil fuels used to generate electricity.

Due to the high cost of building electric generating facilities to meet the ever-growing need for electric power, some electric utilities provide incentives for those consumers who convert to energy saving fluorescent lighting. However, due to technical limitations, fluorescent lights previously required bulky starter and ballast circuits for proper operation, and were not usable with standard incandescent light sockets. As technology has advanced, the reduction in size of starter and ballast circuits, and the development of adapters for using fluorescent lights with incandescent bulb sockets, have made fluorescent lighting a viable alternative to the standard incandescent bulb.

As mentioned, adaptors for using fluorescent lights in standard incandescent bulb sockets are known. Prior art fluorescent light adapters typically include a starter and ballast circuit disposed in a housing having a threaded portion sized to fit in an incandescent bulb socket. A fluorescent tube assembly can then be connected to the starter and ballast circuit, thus completing the conversion from incandescent to fluorescent lighting.

One problem commonly associated with converting from incandescent to fluorescent lighting is the cost of the conversion. Fluorescent light bulbs complete with an incandescent adaptor have tended to cost on the order of two to three times (or more) as much as incandescent bulbs. While the operation of a fluorescent bulb in place of an incandescent bulb will generally, over time, more than cover the cost of conversion due to the corresponding energy cost savings, the initial cost of such a conversion often prevents homeowners businesses from performing the conversion project.

One example of a prior art device for use in converting an incandescent lighting fixture to a fluorescent fixture is shown in FIGS. 1 and 3–6. As can be seen in the FIGURES, a prior art fluorescent light conversion assembly includes a fluorescent tube structure 20 having a base 21 and a plurality of electrical connectors 22 disposed on a connector mount 24.

The connector mount 24 is disposed on a bottom surface 25 of the tube base 21. The internal structure of the tube base is known and includes the wiring connections between the fluorescent tubes and the electrical connectors 22.

A significant feature of prior art fluorescent tube assemblies is the use of a substantially rectangular, hollow support plug 26 disposed on the base 21 which mates with a corresponding receptacle 42 when the fluorescent tube assembly is connected with a starter and ballast circuit housing 30. The support plug 26 provides the tube assembly with support and structural integrity sufficient to maintain the connection between the fluorescent tube assembly 20 and the housing 30 regardless of the orientation (i.e., horizontal, vertical, etc.) of the fluorescent light conversion assembly 10.

Disposed on the plug 26 are a pair of protruding members 28 which serve as a wattage key, i.e., the size and shape of the members 28 are used to code the wattage of the tube assembly 20, to prevent tube assemblies 20 which have higher power requirements from being used with starter and ballast circuits 30 which do not have sufficient power handling capacity to adequately and safely service such a tube structure.

The circuit housing 30 includes a cover 32 which is conical in shape. A plurality of electrical wires 34 are disposed in the cover for providing the connection between the external power supply and the starter and ballast circuit (not shown). A threaded coupling 36 is provided for use in a standard incandescent light bulb socket. A starter and ballast circuit support cap 38 mates with the cover 32 to form an enclosed chamber 35 to house the starter and ballast circuits (not shown). Snap connector rings 58 and 60 are provided on the starter circuit support cap 38 and the cover 32, respectively, to provide a snap fit between the starter support cap 38 and the cover 32.

The upper surface 39 of the starter circuit support cap 38 includes a relieved portion 40 which serves as a receptacle for the connector mount 24. Optional guide slots 41 may be provided in the relieved portion 40 which mate with guide members disposed on the base 21 to ensure proper orientation of the tube assembly 20 when mating with the starter circuit 30. Within the relieved area 40, a receptacle 42 is formed for receiving the support plug 26.

The relieved area 40 includes a planar surface 43 having formed therein a plurality of connector receptacles 44 for receiving the electrical connectors 22. The receptacle 42 has slots 45 formed in side surfaces thereof for receiving the protruding members 28 formed on the side surfaces of the rectangular plug 26. In addition to signifying wattage of the bulb, the protruding members serve to releasably secure the fluorescent tube assembly 20 to the circuit housing 30.

Referring in particular to FIG. 3, the cover 32 is provided with a plurality of air vents 33 to dissipate excess heat which may be generated by the starter circuit. The receptacle 42 is defined by walls 46 which protrude into the cavity 35 formed when the cover 32 is fitted with the support cap 38. As a result, the usable size of the cavity 35 for housing starter and ballast circuit components is effectively reduced by the size of the receptacle 42. In addition, a plurality of cylindrical housings 48 protrude into the cavity 35 to form the connector receptacles 44 which receive the electrical connectors 22 from the fluorescent tube assembly 20. The housings 48 each include a wire connector hole 50 for accommodating electrical connections between an electrical contact 47 disposed in the housing 48 and the starter and ballast circuit. The wires 34 connect with electrical connectors 52 and 54 disposed on a top portion of the threaded coupling 36.

In the prior art fluorescent light conversion assembly 10, the starter and ballast circuits are typically formed using electronic components disposed on a printed circuit board which is mounted on surface 56 defined by the relieved area 40. As can be seen in FIG. 4, the surface 56 has an irregular shape which necessitates the fabrication of a specialized circuit board. In addition, the extension of the receptacle 42 and the housings 48 into the cavity 35 limit the available space for housing the starter and ballast circuits. As a result, unless the size of the cavity is increased, thereby undesirably increasing the overall size of the starter portion 30, the cavity 35 is only capable of accommodating a small, unsophisticated starter and ballast circuit.

Manufacturing starter and ballast circuits for the prior art device discussed above adds significantly to the overall cost of the fluorescent light assembly due to the specialized manufacturing required to accommodate the unusual shape and size of the cavity 35.

Further, due to the limited amount of space in cavity 35 resulting from the protrusion of walls 46 defining receptacle 42 into the cavity 35, the prior art device 10 is unable to accommodate a high power factor ballast circuit. High power factor ballast circuits, which draw less current than low power factor devices, are fast becoming required equipment in fluorescent lighting devices. However, a high power factor ballast circuit includes significantly more components (capacitors, inductors, resistors, transistors, etc.) than a low power factor ballast circuit. With the lack of available space in the cavity 35 of the prior art device 10, it is impracticable to incorporate a high power factor ballast circuit therein without increasing the size of the cavity 35.

Another disadvantage related to the protrusion of the receptacle 42 into cavity 35 is the effect on heat dissipation and the overall size of the starter portion 30. In the illustrated prior art device, the starter portion 30 is bulky, which prevents the device from being used in certain lamps and fixtures having limited space to accommodate a bulb. This is due in part to the size of the cover 32 which is provided with cooling air vents 33 to dissipate the heat generated by the starter and ballast circuit.

The size of the cover 32 must be large enough to provide a cavity 35 that allows sufficient air circulation therein to ensure proper cooling. The protrusion of the receptacle 42 into cavity 35 prevents the reduction in size of the cover 32, and prevents a corresponding reduction in the overall size of the starter portion 30, due to heat dissipation requirements and the lack of space in the cavity 35 in the prior art device.

Accordingly, there is a need for a fluorescent light adaptor module for use in a standard incandescent light bulb socket which is easier and less costly to manufacture. There is also a need for a module which is capable of accommodating a high power factor ballast circuit without increasing the overall size of the device, as well as a need for device of reduced size yet having sufficient heat dissipation capabilities.

SUMMARY OF THE INVENTION

The present invention is directed to a fluorescent light adaptor module suitable for use in a standard incandescent electric bulb socket. The present invention addresses the aforementioned problems associated with prior art fluorescent light assemblies and provides an improved structure for connecting a fluorescent tube assembly to the starter assembly including a starter and ballast circuit. In addition, the present invention provides for increased space within the starter assembly to accommodate additional components for a high power factor ballast, or which allows for the reduction in size of the device. Further, a simplified structure is provided in the portion of the starter assembly housing the starter and ballast circuits. By simplifying such structure, the starter assembly can utilize a printed circuit board which is easier and less costly to manufacture than that of the prior art, thus reducing the overall cost of the device.

These and other advantages of the present invention will become more apparent upon a reading of the detailed description of the preferred embodiment of the present invention when considered in conjunction with the drawings, of which the following is a brief description.

DETAILED DESCRIPTION OF THE PREFERRED EMBODIMENT

Figure 1:
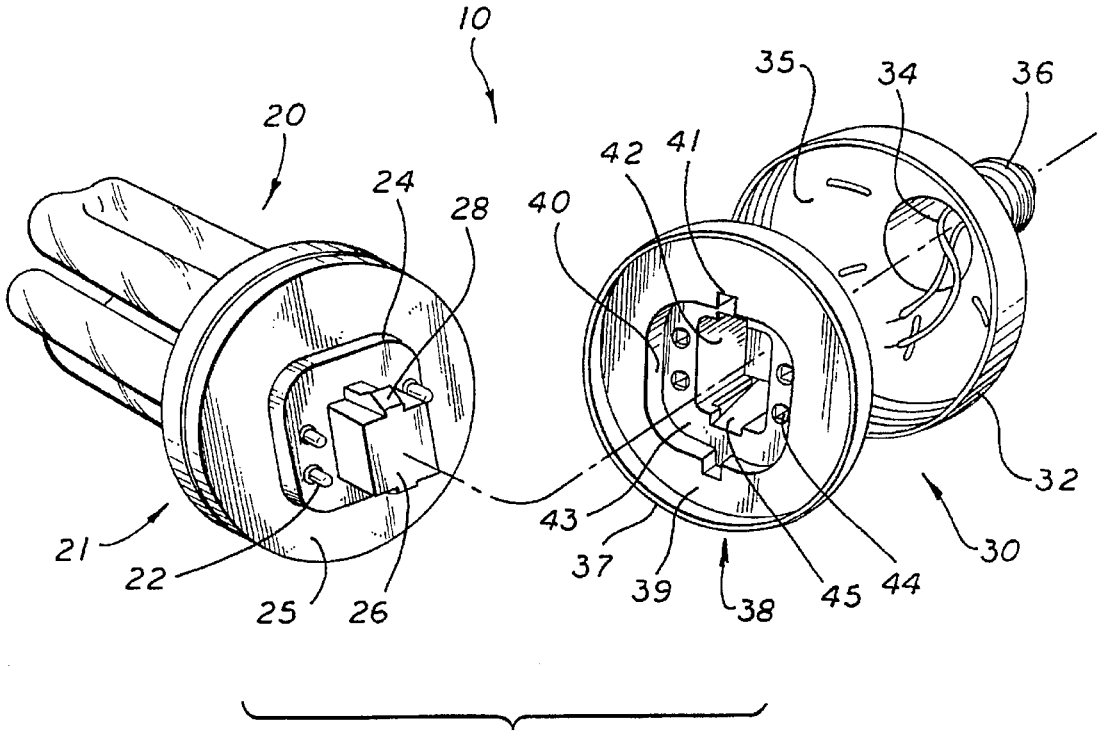
FIG. 1 PRIOR ART
FIG. 1 is an exploded perspective view of a prior art fluorescent light assembly.
Figure 2:
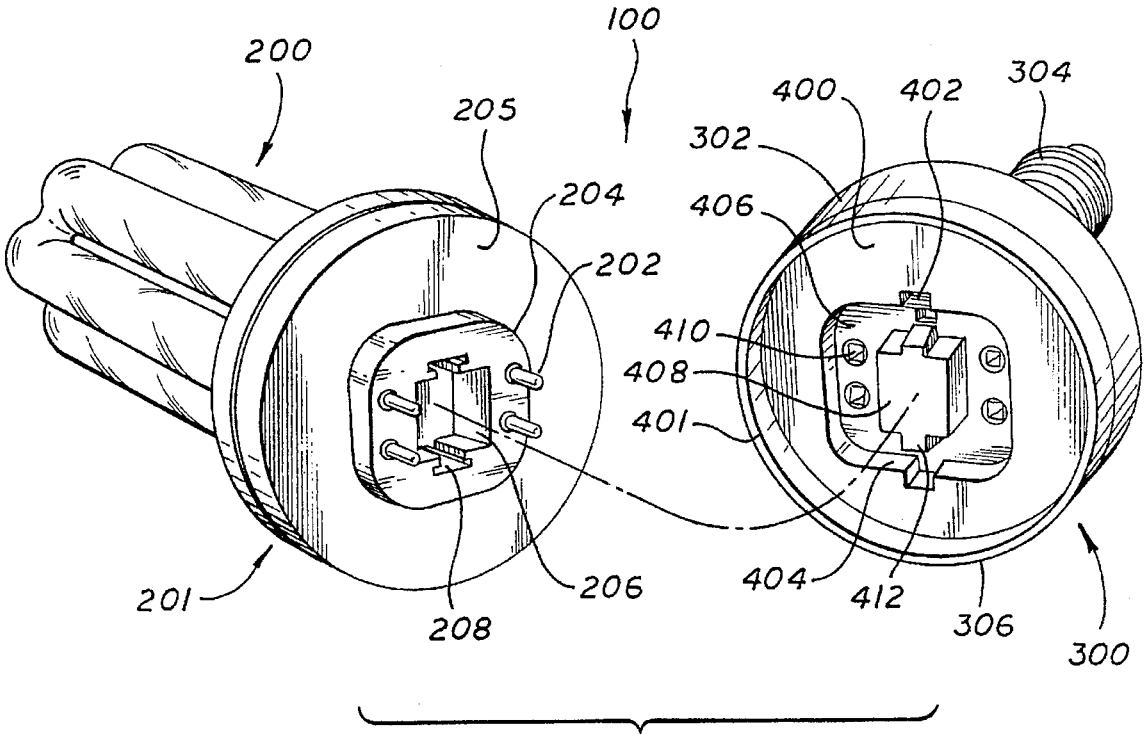
FIG. 2 is an exploded perspective view of a fluorescent light adaptor module in accordance with a preferred embodiment of the present invention.

In the figures, like reference numerals refer to like elements. It should be understood that while FIGS. 2 and 7–10 illustrate a preferred embodiment of the invention, the invention is in no way limited to the illustrated embodiment. Rather, the invention is best defined by the claims appended to this specification.

Referring to FIGS. 2 and 7–10, a fluorescent light adaptor module 100 for use in a standard incandescent bulb socket includes a fluorescent tube portion 200 having a base 201. The bottom surface 205 of base 201 is provided with a connector mount 204 having electrical connectors 202 protruding therefrom. The connector mount 204 includes a receptacle 206 having wattage indicator slots 208 formed in side surfaces thereof. Receptacle 206 receives therein a support plug 408 disposed on the starter assembly 300 of the fluorescent light assembly 100.

Both the base 201 and starter assembly 300 may be made of injection molded plastic or a suitable, durable and electrically insulating material. The base 200 may be bonded to the fluorescent tubes using a suitable adhesive in a known manner.

Figure 7:
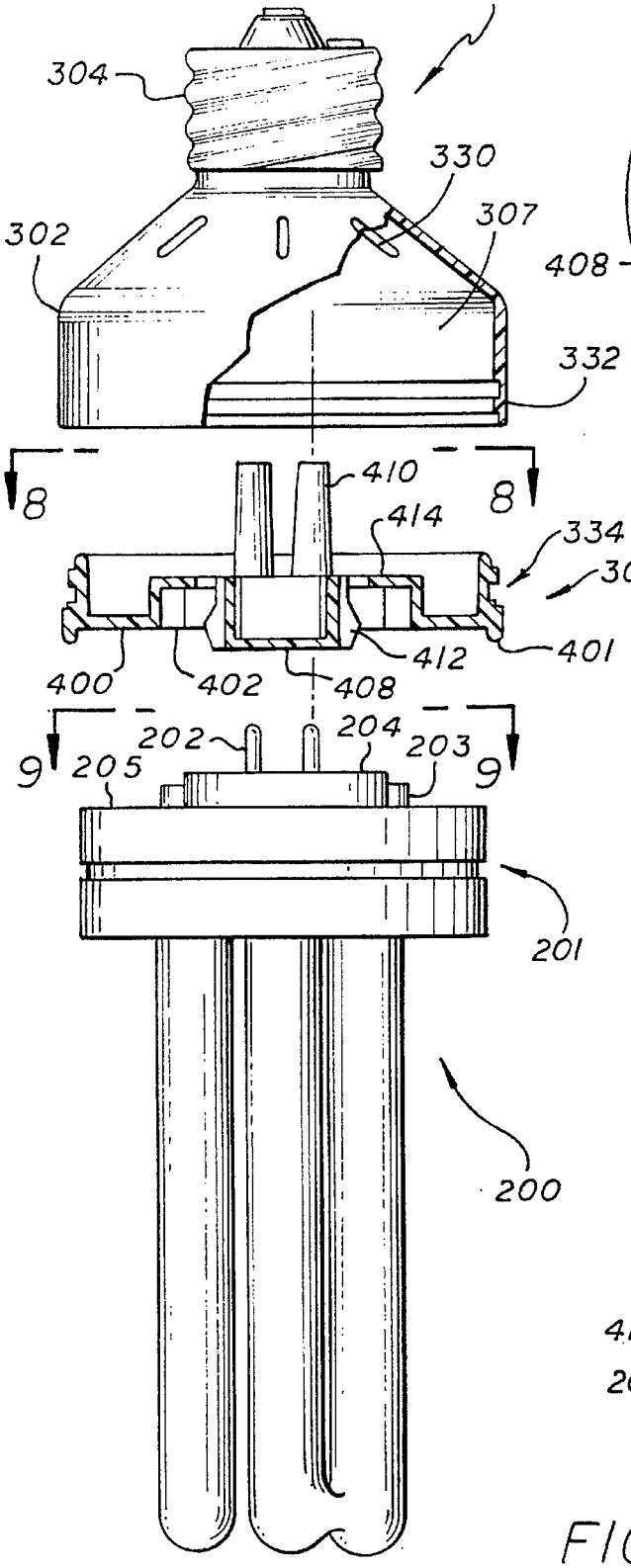
FIG. 7 is an exploded side view of the preferred embodiment of the fluorescent light adaptor module shown in FIG. 2.
Figure 8:
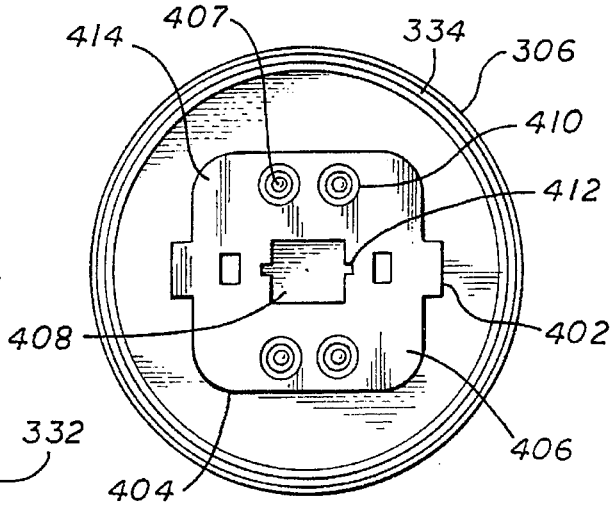
FIG. 8 is a top plan view taken along line 8—8 of FIG. 7.
Figure 9:
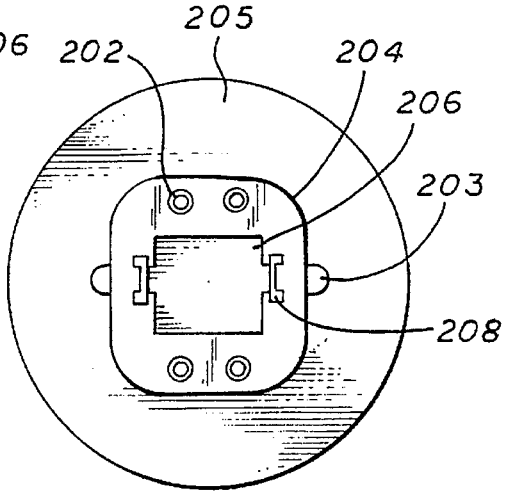
FIG. 9 is a top plan view taken along line 9—9 of FIG. 7.

The starter assembly 300 additionally includes a cover 302 having a threaded base 304 for insertion into a standard incandescent light bulb socket. Cover 302, which is conically shaped as can be seen in FIG. 7, is fitted with a starter and ballast circuit support cap 306 which, when fitted to the cover 302, defines an enclosed cavity 307 for containing a starter/ballast circuit (not shown) therein.

Figure 10:
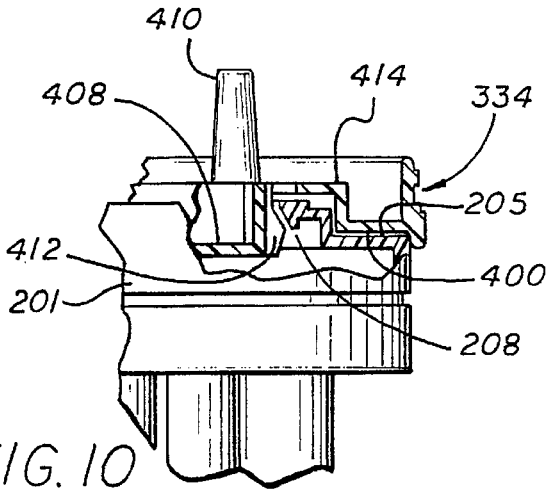
FIG. 10 is partial cutaway side view of the fluorescent light adaptor module illustrated in FIG. 7.

The support cap 306 includes a generally planar surface 400 having a ridge 401 formed about an outer periphery therein. As can be seen in FIG. 10, when the fluorescent tube assembly 200 is mounted with the starter assembly 300, the ridge 401 slightly overhangs the outer circumferential edge of the base 201. This assists in supporting the tube assembly 200 when it is mounted to the starter assembly 300. Referring in particular to FIG. 10, a mounting surface 414 is provided on the support cap 306 for mounting a starter and ballast circuit.

Guide slots 402 may be formed in a relieved area 404 of the planar surface 400 for mating with corresponding guide members 203 formed adjacent the connector mount 204 to ensure proper orientation of the base 201 when joined with the starter assembly 300. The relieved area 404 includes a generally planar surface 406 having a support plug 408 protruding therefrom. The plug 408 mates with the receptacle 206 formed in the base 201 of the fluorescent tube assembly 200. The support plug 408 supports the tube assembly 200 when it is connected with the starter assembly 300.

Electrical receptacles 410 having electrical contacts 407 disposed therein are formed in the generally planar surface 406 of the relieved area 404. The receptacles 410 are sized to accommodate the electrical connectors 202 which are disposed on the connector mount 204. Protruding members 412 are formed on opposite side surfaces of the plug structure 408. The members 412 and the slots 208 formed in the receptacle 206 can be sized or shaped in accordance with a predetermined wattage such that a starter assembly 300 having a specified wattage rating may only be used with a fluorescent tube assembly 200 having a corresponding wattage rating. In addition, the protruding members 412 can serve to enhance the connection between the plug 408 and the receptacle 206 or to releasably secure the tube assembly 200 to the starter assembly 300.

The structure of the support cap 306 need not be limited to use with the screw-type base 304 on cover 302. That is, the exterior of the support cap 306, including plug 408 and electrical connectors 410, could be adapted for use in a hard-wired fluorescent light starter and ballast circuit for use in, for example, a hard wired lighting fixture or a plug-in lamp. The attendant advantages of the present invention are not limited to screw-type starter assemblies.

It should be also understood that the fluorescent tube assembly 200 including base 201 is not limited to use with the starter assembly 300 shown in the drawings. That is, the starter assembly 300 shown in the drawings is for use in a screw-type incandescent bulb socket. However, it is possible to utilize the fluorescent tube assembly 200 with a hard-wired starter assembly having the appropriate mating structure such as plug 408 to mate with the base 201. Thus, a lamp or a light fixture could be provided with a hard-wired fluorescent "socket" having a starter assembly with a structure similar to starter assembly 300 shown in the drawings but which is permanently wired as opposed to having the screw base shown in the drawings.

As can be seen in FIG. 7, the cover 302 of the starter assembly 300 is provided with a plurality of air vents 330 in order to allow for proper ventilation and heat dissipation in the starter assembly 300. Respective snap connector rings 332 and 334 are formed on the cover 302 and the support cap 306 and provide for a standard snap connection between the cover 302 and the cap 306. When the cap 306 is fitted in place on the cover 302, an enclosed chamber or cavity 307 is formed to house the starter and ballast circuit.

Figure 3:
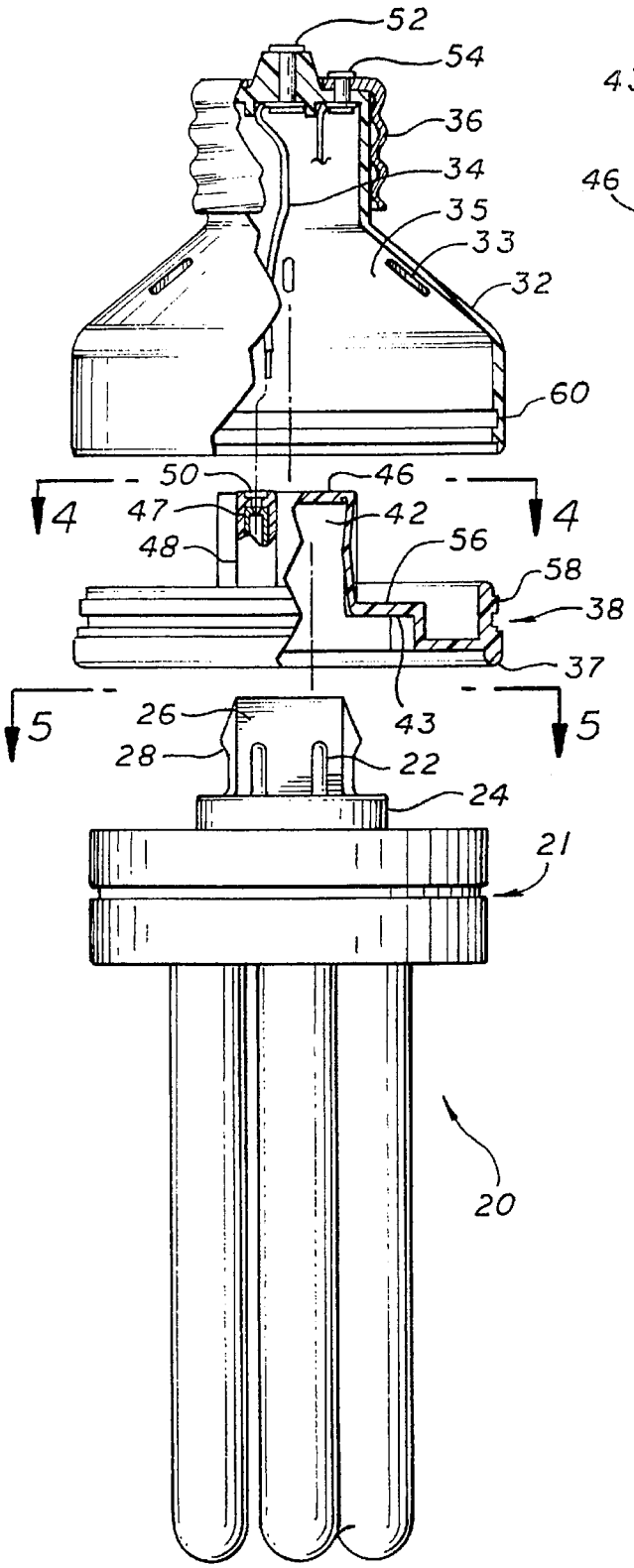
FIG. 3 PRIOR ART
FIG. 3 is a side exploded view of a prior art fluorescent light assembly.
Figure 4:
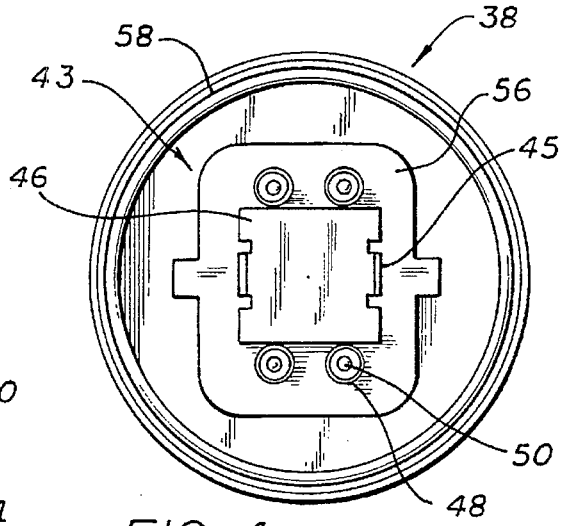
FIG. 4 PRIOR ART
FIG. 4 is a top plan view taken along line 4—4 of FIG. 3.
Figure 5:
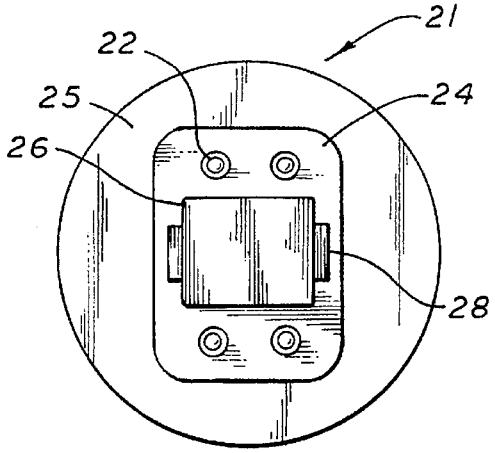
FIG. 5 PRIOR ART
FIG. 5 is a top plan view taken along line 5—5 of FIG. 3.
Figure 6:
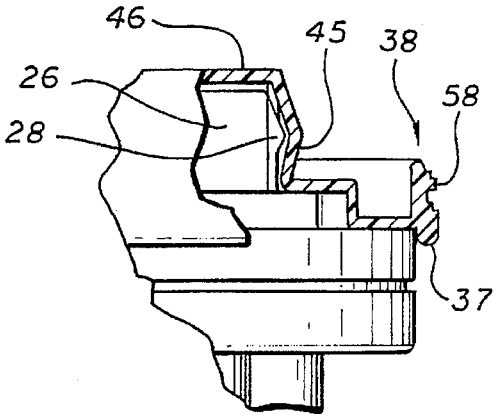
FIG. 6 PRIOR ART
FIG. 6 is a partial cutaway side view of the prior art fluorescent light assembly shown in FIG. 3.

As can be seen in the prior art fluorescent light assembly shown in FIG. 3, the receptacle 42 having walls 46 protrudes into the cavity 35 which houses the starter and ballast circuits (not shown). Accordingly, as was discussed above in conjunction with the background of the invention, the starter and ballast circuits of the prior art must be mounted on a surface 56 which is defined by protrusion of the planar surface 43 of the relieved area 40 into the cavity 35. The available space is limited due to the protrusion into the cavity 35 of the receptacle 42 defined by walls 46 which extend between the electrical receptacle housings 48.

By having the receptacle housing 46 protrude into the cavity 35, a substantial portion of the cavity 35 cannot be utilized to accommodate starter and ballast circuits. Further, the block-like structure of the receptacle 42 makes it necessary for prior art devices to rely upon specially configured printed circuit boards which are cut to fit about the receptacle 42 and the connector housings 48.

Referring to FIG. 7, in the present invention the connector receptacles 410 protrude above the mounting surface 414 which accommodates a printed circuit board (not shown) having formed thereon the starter and ballast circuits. The connector receptacles 410 assist in securing the printed circuit board to the mounting surface 414. Since the present invention is not limited by the protrusion of a receptacle structure into the cavity 307, there is significantly more area within the cavity 307 to accommodate the starter and ballast circuits. Accordingly, high power factor ballast circuits having significantly more components than the low power factor ballast circuits used in prior art devices may be installed in the starter assembly 300 of the present invention without increasing the overall size of the assembly 300 in comparison with the prior art device 30.

In addition, as is known, starter and ballast circuits generate heat during operation thereof. The cavity 307 must be of sufficient size to allow air circulation through vents 330 to dissipate the heat generated. If the heat is not dissipated, it could damage the starter and ballast circuit components. Due to the increase in area within the cavity 307, if more components are not added to the starter and ballast circuit, the size of the cavity 307 may be reduced without effecting the ability of the starter assembly 300 to adequately dissipate heat from the cavity 307.

In addition, fewer and less complicated steps are required to manufacture the printed circuit board for use in the cavity 307. The circuit board need only be drilled to produce holes to receive the connector housings 410. There is no need to cut or stamp the circuit board to enable the circuit board to fit about the rectangular walls 46 and the connector housings 48 of the prior art.

By modifying the manner in which the fluorescent tube assembly 200 is coupled to the starter assembly 300 using the support plug 408 and the receptacle 206, as detailed in FIGS. 2 and 7–10, a fluorescent light adaptor module 100 which does not require complicated printed circuit boards and which can accommodate high power factor ballast circuits is achieved. By simplifying the internal structure of the starter assembly 300, the present invention provides a fluorescent light adaptor module 100 that may be manufactured in a simpler, more efficient fashion and at a reduced cost when compared with the prior art, yet still provide a reliable, secure coupling between the tube assembly 200 and the starter assembly 300.

Further, the fluorescent tube assembly may be utilized with starter assemblies that are permanently wired to an electric supply and need not be limited to use with the illustrated starter assembly having a screw-type base.

With respect to the manufacture of the device discussed above, all of the components thereof exclusive of the metal electrical connectors, circuit electronics, and the printed circuit board, may be injected molded using a suitable plastic material, for example, lexan. Such manufacturing is known by those skilled in the art.

While the inventor's preferred embodiment has been disclosed above, it is clear that numerous modifications and or additions may be made to the preferred embodiment without departing from the spirit and scope of the present invention. For example, while the preferred embodiment incorporates receptacles 410 in the starter support cap 306, it may be possible to exchange the position of such receptacles with the electrical connectors 202 in the tube base 201, thereby increasing the internal capacity of the cavity 307 even more.

Further, while the invention has been illustrated as having a circular base 201 and starter assembly 300, it is clear that such elements could be rectangular, or any suitable shape, and fall within the scope of the present invention. Similarly, while the support plug 408 and receptacle 206 have been shown in the preferred embodiment to be rectangular, such elements could also be formed in any desired shape such as circular, triangular, etc., without departing from the scope of the present invention.

In addition, while the drawings illustrate a screw base on the starter assembly 300, it is clear that the present invention could be utilized in a hard-wired configuration with a starter assembly having a starter and ballast circuit therein being wired to the power supply or power supply cord, with the fluorescent tube assembly being connectable to such starter assembly.

Additionally, it may be possible to change the form of the connection between the cap 306 and the cover 302 from a snap connection to, for example, a friction fit, or to seal it completely. It is intended that all such modifications fall within the scope of the present invention.

I claim:

1. A fluorescent light adaptor module comprising:

a fluorescent tube assembly including a base for supporting at least one fluorescent tube, said base having at least one first electrical connector disposed thereon, said at least one electrical connector being adapted for electrical connection to said fluorescent tube, a starter assembly including a cavity for containing a starter and ballast circuit thereon and a cap defining one end of said cavity, said cap including at least one second electrical connector disposed therein, said at least one second electrical connector being adapted for electrical connection to said starter and ballast circuit and said at least one first electrical connector;

a support member, protruding from said cap, for supporting said tube assembly; and a receptacle, disposed in said base, for receiving said support member.

2. An adaptor module according to claim 1, wherein said support member comprises a substantially rectangular plug and said receptacle comprises a substantially rectangular receptacle, said rectangular receptacle releasably securing said plug in a friction fit.

3. An adaptor module according to claim 2, wherein said plug has formed thereon at least one wattage indicating member for indicating a wattage rating of said starter assembly.

4. An adaptor module according to claim 3, wherein said rectangular receptacle has formed therein a wattage indicator slot defining a wattage rating of said fluorescent tube assembly, wherein at least one of said wattage indictor slot and said wattage indicator member are formed of a predetermined size so as to prevent said plug from entering said receptacle unless a wattage rating of said starter assembly and a wattage rating of said fluorescent tube assembly are equal.

5. A fluorescent light adaptor module comprising:

a housing defining a cavity therein;

a screw-type electrical connector for connecting said housing to an incandescent light bulb socket disposed on one end of said housing;

an end cap disposed on another end of said housing, said end cap having at least one first electrical connector disposed therein and at least one rigid support member protruding therefrom;

a starter circuit disposed within said cavity and adapted for electrical connection to said at least one first electrical connector; and a fluorescent tube assembly, removably secured with said end cap, including a base for supporting at least one fluorescent tube, said base having at least one second electrical connector adapted for electrical connection to said at least one fluorescent tube and said at least one first electrical connector, and a receptacle formed in said base, said at least one rigid support member being removably coupled with said receptacle.

6. The module of claim 5, wherein said at least one rigid support member includes locking means for releasably locking said member in said receptacle.

7. The module of claim 6, wherein said locking means comprises at least one protuberance, extending from said at least one rigid support member, said receptacle including a slot adapted to receive said at least one protuberance.

8. The module of claim 5, wherein said receptacle and said at least one rigid support member are formed so as to provide a friction fit therebetween.

9. The module of claim 5, wherein said at least one rigid support member comprises a substantially rectangular member which extends a predetermined distance from said end cap, and said receptacle comprises a substantially rectangular cavity having a predetermined depth corresponding with said predetermined distance formed in said base.

10. The module according to claim 5, wherein said at least one rigid support member comprises a substantially rectangular plug member having a predetermined length protruding from said end cap, said receptacle being substantially rectangular and adapted to provide a friction fit with said plug member.

11. The module of claim 10, wherein said plug member has at least one guide member formed thereon, said receptacle including means for receiving and releasably securing said at least guide member therein.

12. The module of claim 10, wherein said plug member includes wattage indicating means for indicating a preferred fluorescent tube wattage for use with said starter circuit, said receptacle including means for indicating a predetermined wattage of said at least one fluorescent tube, wherein said plug member is prevented from being inserted in said receptacle when said preferred wattage and said predetermined wattage are different.

13. The module of claim 5, wherein said base includes at least a first side surface and a second side surface, wherein said at least one fluorescent tube protrudes from said first side surface, said receptacle being formed in said second side surface, said receptacle comprising an opening formed in said second side surface such that said rigid support member protrudes into said base when received in said receptacle.

14. The module of claim 3, wherein said opening comprises a substantially rectangular cavity defined by at least two side walls which protrude into said base member a predetermined distance.

15. The module of claim 14, wherein said second side surface includes a raised member protruding therefrom, said rectangular cavity being formed in said raised member.

* * * * *